US006190232B1

(12) United States Patent
Boser

(10) Patent No.: US 6,190,232 B1
(45) Date of Patent: Feb. 20, 2001

(54) METHOD OF ATTACHING AN UNDERWIRE TO A BRASSIERE CUP

(76) Inventor: Ronald Boser, 3951 Industrial 25th St., Ft. Pierce, FL (US) 34946

( * ) Notice: Under 35 U.S.C. 154(b), the term of this patent shall be extended for 0 days.

(21) Appl. No.: 09/405,063

(22) Filed: Sep. 27, 1999

(51) Int. Cl.[7] ..... A41C 1/14

(52) U.S. Cl. ..... 450/47; 450/41; 450/92; 450/52; 112/475.09; 112/475.06

(58) Field of Search ..... 450/41, 47, 49, 450/51, 52, 92; 112/470.33, 475.09, 113, 475.06

(56) References Cited

U.S. PATENT DOCUMENTS 4,203,449 * 5/1980 Winzelberg ..... 450/47
5,215,494 * 6/1993 Flanagan ..... 450/41

* cited by examiner

*Primary Examiner*—Gloria M. Hale
(74) *Attorney, Agent, or Firm*—Myron Amer PC

(57) ABSTRACT

The manufacturing and wearing benefits of a brassiere having an underwire embodied in each brassiere cup which has a small radius curvature so that it seats within a cooperating infra mammary fold, and provides uplifting support during wearing of the brassiere.

2 Claims, 2 Drawing Sheets

METHOD OF ATTACHING AN UNDERWIRE TO A BRASSIERE CUP

The present invention generally relates to an improved brassiere construction in which, more particularly, the improvement resides in brassiere construction aspects being correlated to breast anatomical aspects to contribute to enhancing comfort and uplifting support during wearing of the brassiere, all as will be better understood as the description proceeds.

EXAMPLE OF THE PRIOR ART

As known from common experience and for obvious reasons, the bottom of a brassiere cup is typically of a U and/or semi-circular shape to thusly conform in shape to the bottom shape of a breast. In the U and/or semi-circular brassiere cup shape it is known to use a shape-conforming component, usually of wire construction material and known in trade parlance as an "underwire". Exemplary of prior art patents disclosing and illustrating a brassiere cup underwire is U.S. Pat. No. 4,203,449 for "Stretchable Underwire Casing For Breast Pockets" issued to Leo L. Winzelberg on May 20, 1980.

In the '449 and all other known patents there is the conformance in shape noted between the bottoms of the brassiere cup and breast, but there is overlooked additional possible correlation between these shapes which could contribute to greater comfort and support during wearing of the brassiere.

Broadly, it is an object to provide an improved constructed brassiere overcoming the foregoing and other shortcomings of the prior art.

More particularly, underlying the present invention is the recognition that anatomically the forwardly projecting position of a breast by its sheer weight creates an anatomical circumstance beneath a breast known in medical parlance as an infra mammary fold, and it is a further object to seat the underwire in the noted infra mammary fold to further correlate shape conformance between the brassiere cup and breast to the end of increasing comfort and uplifting support during wearing of the brassiere.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
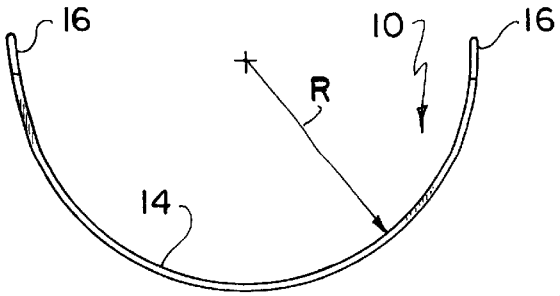
FIG. 1 is an isolated front elevational view of a brassiere cup underwire used in the construction of a brassiere in accordance with the method of the present invention.
Figure 4:
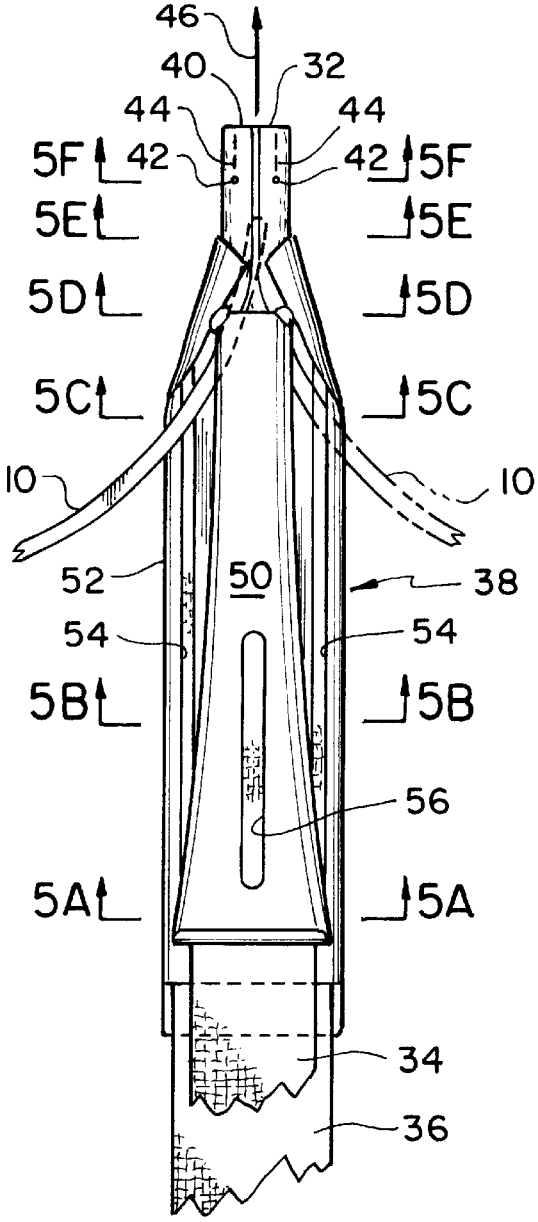
Figure 5F:
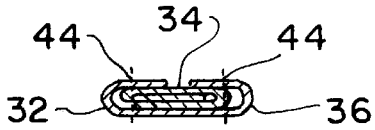
Figure 5E:
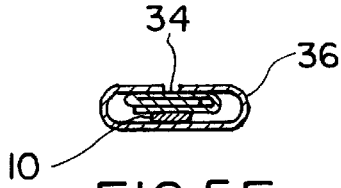
Figure 5D:
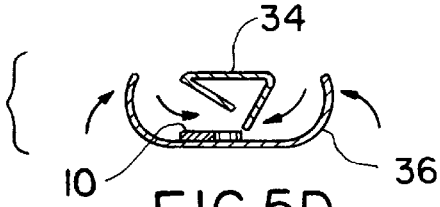
Figure 5C:
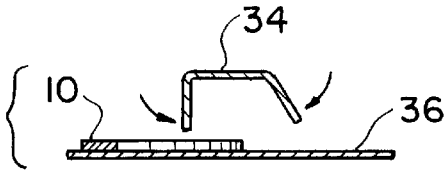
Figure 5B:
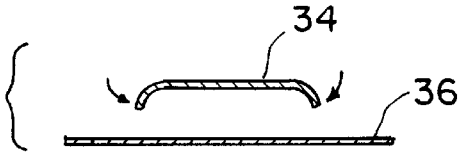
Figure 5A:
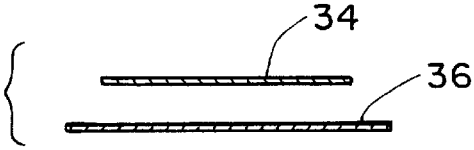

FIG. 4 is a partial plan view of a folder used in the practice of the within inventive method for folding a fabric casing about the underwire of FIG. 1 preparatory to attachment to a brassiere cup; and FIGS. 5A, 5B, 5C, SD, 5E and 5F are cross sectional views, taken respectively along lines 5A—5A, 5B—5B, 5C—5C, 5D—5D, 5E—5E, and 5F—5F of FIG. 4, illustrating in sequence the folding of the fabric casing about the underwire.

Illustrated in FIG. 1 is a so-called brassiere cup underwire, generally designated 10 which, as is well known, is used to hold the shape of each brassiere cup 18 and 20 (FIG. 2), particularly along the bottom peripheral edge of the cups. In a preferred embodiment, the wire 14 per se is typically of a steel spring construction material, such as in the range of 0.025 inches by 0.085 inches, and of a radius R which, in the practice of within inventive method is a measurement that is selected in accordance with breast sizes of prospective users and, more important, is related to the partial circumferential location of a user's so-called infra mammary fold. Thus referring to FIG. 3, breast 58 in the size illustrated presents an infra mammary fold 59 at the juncture at which it projects forwardly of the chest of the user, the significance of which fold 59 will become more apparent as the description proceeds.

Returning to FIG. 1, it will be noted that tips 16 of the wire 14 are rounded and coated with vinyl to minimize the inadvertent projecting of an end through a fabric casing 32. The vinyl is typically color coded to specific bra cup sizes.

Figure 2:
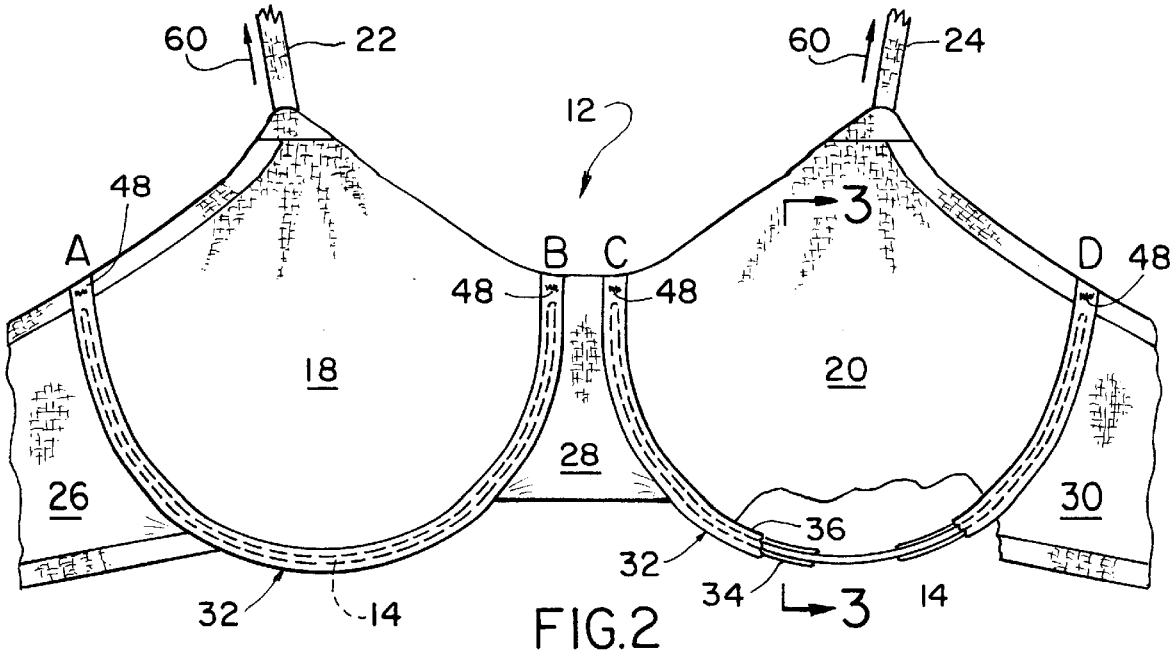
FIG. 2 is a partial elevational view of a brassiere as seen from the inside with cups and the underwire of FIG. 1 shown in hidden line embodied in the construction thereof.

In the partial view of the brassiere or bra 12 in FIG. 2, there is shown the left and right bra cups 18 and 20, conventional shoulder support straps 22 and 24, side support panels 26 and 30 and intermediate panel 28. The partial broken away of fabric casing 32 consisting of fabric strips or tapes 34 and 36, illustrates in full line the operative position of the wire 14.

Figure 3:
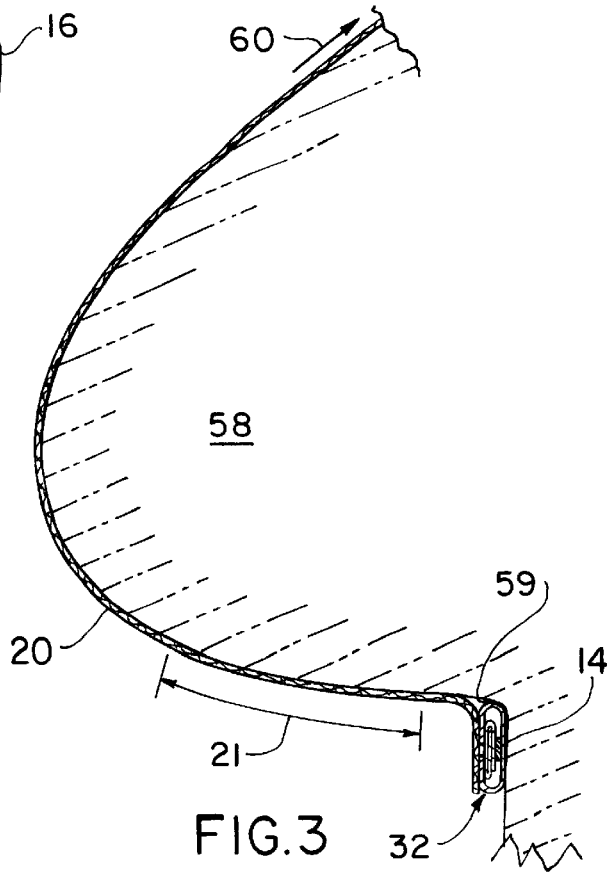
FIG. 3 is a side elevational view, in section taken along line 3—3 of FIG. 2, illustrating the position of a shaped brassiere cup on a user.

As best seen in FIG. 3, each casing 32-embodied wire 14 is constructed so as to assume a position at the infra mammary fold 59 of the sized and shaped breast 58, so that cup 20, being that positioned on the right, has a bottom length portion 21 that supplies support from beneath at what can aptly be characterized as the cantilever extension from the chest of the breast 58. In practice, it has been found that the specific directional support noted significantly contributes to the comfort in the wear of the bra 12.

Also, as best illustrated in FIG. 3, wire 14 is encased by casing 32 in arcuate relation to cups 18 and 20. Casing 32 is made of an inner tape 34 and an outer tape 36. Using a folder 38, the wire-embodied casings 32 are stitched to bra cups 18 and 20 on a double needle sewing machine.

The folding encasement of wire 10 in a cooperating casing 32 is best understood from FIG. 4 and from the folding steps shown in sequence in FIGS. 5A–5F. The folder, generally designated 38, is shown at a sewing station from which a casing end 40 is exiting therefrom that was previously folded and sewn. At the sewing station, there are double vertically reciprocating needles 42 that, in a manner well known, produce parallel stitches or seams 44. Underwire 10, as shown in full line, is assumed to be the first sewn in a casing 32 preparatory to being sewn to the left bra cup 18, and is followed by an underwire 10, shown in phantom line perspective, within an enclosing casing 32 preparatory to being sewn to the right side bra cup 20. In the well understood operation of a sewing machine (not shown), the bra cup 18 and casing 32 are urged in unison in a machine direction 46.

Preparatory to the sewn attachment of the wire-embodied casing 32 to the left bra cup 18, the seamstress raises the foot on the sewing machine and locates bra 12 so that point B (see FIG. 2) comes under needles 42. The foot is then lowered and wire 10 is located as shown. The seamstress guides the assembly while sewing until point A is reached. When casing 32 then reaches point A, it is cut. Both ends A and B of casing 32 are finished, with tack stitch 48, or are otherwise appropriately finished.

From a perspective of looking at the inside of the bra, when right cup 20 is sewn, the sewing operation is the same, with the sewing proceeding from point C to point D on the right cup 20.

Reference should now be made to FIGS. 5A–5F, in which for simplicity, the illustrations have been confined mainly to the tapes 34 and 36 as they are advanced through the folder 38 on top of a mounting bracket (not shown) at the sewing site, the advancement being in relation to upper and lower flattened sheet metal tubes respectively designated 50 and 52 in FIG. 4; said tubes being configured to produce folding of the tapes 34 and 36, as they are advanced by the tension of the sewing machine feed dog. Initially, tape 36 is fed into tube 52 and advanced with a probe (not shown) through edge bounding slots 54. In similar fashion tape 34 is fed into tube 50 and also advanced with a probe through slot 56.

Both tapes 34 and 36 start in a flat position as shown in FIG. 5A. In FIG. 5B, the outer edges of tape 34 are folded downward while tape 36 remains flat ready for the insertion of wire 10. In FIG. 5C, tape 34 is further formed with its left side in a position of movement beyond the right side of wire 10 which is now positioned as shown in FIG. 5D, in which it is shown that tape 34 is almost folded in "thirds", while tape 36 has entered the spacing between the double needles 42, which in a preferred embodiment is 0.240 inches and starts to wrap both wire 10 and tape 34.

FIG. 5E shows both tapes folded, with tape 34 on top of wire 10, both wrapped by tape 36, ready for stitching as seen in FIG. 5F.

Underlying the present invention is the recognition that comfort is significantly enhanced by the support 21 provided at the location noted beneath the user's breasts. More particularly, as best understood from FIG. 3, the assembled bra with support wire(s) is shown. Casing 32 is caused to rest snugly at the infra mammary fold 59 while right breast 58 is supported and uplifted by cup 20 which is, in turn, urged in the direction of arrow 60 by strap 24. Similar action takes place on the user or wearer's left breast 18.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of embodying a fabric-encased underwire peripherally about each one of a pair of bra breast cups comprising the steps of:

a. using an outwardly projecting C-shaped bra breast cup having an inwardly located edge of a selected diameter adapted to be in contact about a breast of a user;

b. selecting as said diameter of said breast-contacting bra breast cup edge a diameter characterized as having a small radius curvature;

c. selecting a curved underwire having said same small radius curvature of said breast-contacting bra breast cup edge so as to have a leading end curvature and a trailing end curvature and an intermediate nominal length portion of nominal curvature therebetween;

d. using a sewing station having two sites of sewing needle penetration spaced apart from each other a dimension of approximately 0.240 inches;

e. folding into an assembly a fabric casing about said underwire in advance of said sewing station;

f. urging said assembly in longitudinal movement through said sewing stations so that said underwire leading end curvature exits from said sewing station and said underwire trailing end curvature enters into said sewing station and said intermediate nominal length portion of nominal curvature is positioned between said sites of sewing needle penetration;

g. sewing said assembly of said fabric casing and underwire together; and h. using said sewn assembly of fabric casing and underwire by positioning said breast-contacting bra breast cup edge so as to overlie an infra mammary fold beneath a breast of a user;

whereby a user's breast extending outwardly immediately adjacent from said infra mammary fold is in an interposed position between said encased underwire and a strap supported upper edge of said bra breast cup to contribute to providing firm support of a breast within said C-shaped bra breast cup.

2. A method of wearing a brassiere constructed in accordance with the method of claim 1, said method of wearing comprising the steps of seating fabric-encased underwires in respective infra mammary folds of a user, inter-engaging free ends of side straps at a mid-back location of the user to hold said seated conditions of fabric-encased underwires, and using shoulder straps connected to extend from attachment sites of a front and rear of said brassiere in looping relation over a user's shoulders, whereby an uplifting force is applied against the user's breasts to contribute to comfort and support during the wearing of the brassiere.

* * * * *